US007063444B2

(12) United States Patent
Lee et al.

(10) Patent No.: US 7,063,444 B2
(45) Date of Patent: Jun. 20, 2006

(54) OMNI-DIRECTIONAL WORKLIGHT

(75) Inventors: Wade Lee, Danville, CA (US); Donald R. Sandell, San Jose, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 11/061,829

(22) Filed: Feb. 17, 2005

(65) Prior Publication Data

US 2005/0117340 A1 Jun. 2, 2005

Related U.S. Application Data

(60) Provisional application No. 60/545,430, filed on Feb. 17, 2004.

(51) Int. Cl.
*F21S 8/08* (2006.01)
*F21V 33/00* (2006.01)

(52) U.S. Cl. ..... 362/285; 362/184; 362/191

(58) Field of Classification Search ..... 362/184, 362/190, 191, 239, 250, 285, 286, 386, 413, 362/414, 418; 340/321
See application file for complete search history.

(56) References Cited

U.S. PATENT DOCUMENTS 2,237,536 A 4/1941 Wells, Jr.
3,591,795 A * 7/1971 Neesbye-Hansen ..... 362/184
3,805,053 A 4/1974 Julinot ..... 240/51.11 R
4,885,670 A 12/1989 Baake ..... 362/400
5,142,463 A * 8/1992 Panagotacos et al. ..... 362/285
5,319,365 A 6/1994 Hillinger ..... 340/908.1
5,528,477 A 6/1996 Carmo ..... 362/260
5,630,660 A 5/1997 Chen ..... 362/183
5,684,452 A 11/1997 Wang ..... 340/321
6,265,969 B1 7/2001 Shih ..... 340/468

* cited by examiner

*Primary Examiner*—Y. My Quach-Lee
(74) *Attorney, Agent, or Firm*—Elliot B. Aronson

(57) ABSTRACT

A portable worklight providing a high level of substantially omni-directional illumination. Briefly, the worklight includes an elongate lamp section including one or more lamp sockets for receiving one or more small fluorescent lamps such as compact fluorescent lamps of the screw-in variety. The lamp section includes a substantially transparent shield about the lamps and is structured and arranged to provide illumination substantially in a full circle about the lamp section. The lamp section is retractable into an elongate base section that is shaped and structured to receive the lamp section snugly in its interior. In the retracted configuration the worklight forms a compact unit for carrying, transporting and storing the worklight. The worklight may also include legs that may be retracted along the base section and deployed for supporting the worklight during use.

18 Claims, 9 Drawing Sheets

OMNI-DIRECTIONAL WORKLIGHT

This application claims the benefit of provisional application No. 60/545,430 filed Feb. 17, 2004.

BACKGROUND OF THE INVENTION

The present invention relates to portable worklights providing wide area lighting.

Portable worklights are well known for use on construction sites, in automotive shops, for do-it-yourself projects around the home and for many other uses. The worklights typically take the form of one or more worklight heads mounted on a base, which may form a stand for setting the worklight on the ground or work surface and which may additionally or alternatively be formed for mounting on a tripod. The worklight heads are generally directional in that they illuminate a confined area lying in a particular direction. In some models the heads are designed to provide a wide area of illumination extending, say, in the forward direction; in other models the illumination may be more focused. In recent years worklights using halogen lamps as the light source have been popular because these lamps are extremely bright. More recently, fluorescent lamps have been used in worklights and in particular the so-called compact fluorescent lamps having a self-contained ballast. To provide a wider area of coverage or to provide more light or both, a common form of worklight includes two worklight heads mounted on the same base, which may be aimed in different directions.

In some circumstances the directional nature of the worklight is undesirable. For example, when two or more construction workers are working in the same room, they may each need a conventional worklight to illuminate their respective work areas. It is not uncommon to find several worklights in a room under construction or even two worklights placed back-to-back in a makeshift attempt to provide more comprehensive 360-degree illumination, for example, for painting the room.

SUMMARY OF THE INVENTION

The present invention provides a new form of portable worklight that can be energized to provide a high level of substantially omni-directional illumination. Briefly, the worklight includes an elongate lamp section including one or more lamp sockets for receiving one or more small fluorescent lamps such as compact fluorescent lamps of the screw-in variety. The lamp section includes a substantially transparent shield about the lamps and is structured and arranged to provide illumination substantially in a full circle about the lamp section. The shield member may be clear or it may be frosted or otherwise treated or structured to diffuse the light, but the light is not confined to any particular radial direction or range of directions around the longitudinal axis of elongate lamp section. The lamp section is retractable into an elongate base section that is shaped and structured to receive the lamp section snugly in its interior. In the retracted configuration the worklight forms a compact unit for carrying, transporting and storing the worklight.

During use the worklight base section is supported on a stand. The base section may be adapted to be mounted on a separate stand such as a separate tripod. Preferably, however, a stand is affixed to the base section that can be collapsed for storage and transportation and deployed when the worklight is to be used. The stand preferably comprises a plurality of legs that are attached to the base section so as to retract into or fold up into a collapsed configuration against the base section. During use the legs are deployed into a support configuration to support the worklight during use.

The lamp section may include one or more lamps. A particularly advantageous embodiment includes two lamp sockets disposed in opposition to one another so as to maintain a pair of lamps mounted in the sockets in end-to-end alignment with one another substantially along the longitudinal axis of the elongate lamp section.

It is a feature of some embodiments of the invention that the worklight includes a switch assembly arranged such that the lamps are energized automatically when the lamp section is extended from the base section for use so that no switch need be manually actuated by the user. The switch assembly automatically shuts off the power to the lamps when the lamp section is retracted into the base section.

It is another feature of the invention that the worklight may include a low-powered light indicator such as one or more LEDs that are automatically energized when the lamp section is retracted into the base section while leaving the worklight plugged into an electrical outlet. The energized light indicators provide a warning that the unit is still plugged in and also provide a visible landmark for finding the worklight in the dark when the worklight is intentionally left plugged in.

Other aspects, advantages and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
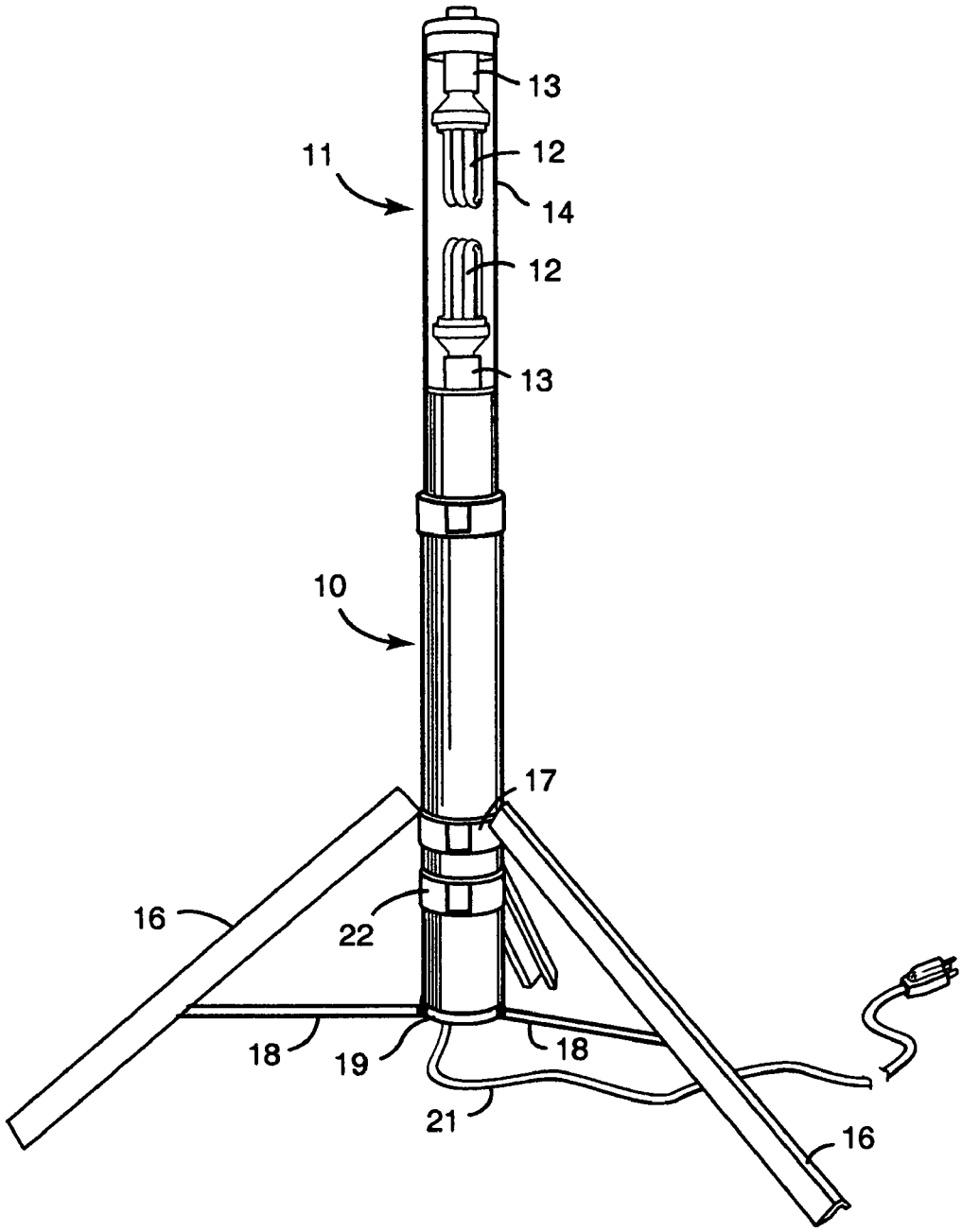
FIG. 1 is an overall perspective view of an embodiment of a worklight in its deployed configuration according to the invention.

FIG. 1 shows an embodiment of a worklight according to the invention, which includes an elongate base section 10 and an elongate lamp section 11, which is formed and dimensioned to retract into the base section. The lamp section houses a pair of fluorescent light bulbs 12 of the screw-in variety that are received in sockets 13 disposed in the lamp section generally toward opposite ends of the lamp section so as to face one another. Lamp section 11 includes a shield member 14 substantially surrounding bulbs 12, which provides protection for the bulbs, yet permits the light to pass. In the embodiment shown here the member 14 is clear although it can also be diffusive to provide a softer light, reducing glare and at least partially obscuring the bulbs from view.

The worklight is preferably configured to use so-called compact fluorescent lamps. More generally, the worklight may be used with fluorescent lamps of the sort that have a self-contained ballast and are configured with their electrical contacts at one end. The use of such bulbs provides for a compact lamp section and uncomplicated wire routing and avoids the complication of including a separate fluorescent ballast in the body of the worklight.

In the illustrated embodiments the sections 10 and 11 are generally cylindrically shaped with a generally circular transverse cross section. This particular shape is not necessary, however. The sections are elongate, but the transverse cross sections may take other forms for such reasons as decorative appearance, structural rigidity, or manufacturability. The sections should be appropriately shaped and dimensioned, however, so that lamp section 11 can retract into base section 10.

During use, the worklight is mounted on a stand for support. In the embodiments illustrated here the stand is permanently affixed to the base section and is arranged to fold up into a compact unit for carrying and storage. In other embodiments, however, the stand could be provided by a separate unit such as a tripod of appropriate size, and in this embodiment base section 10 would then be adapted at its lower extremity for mounting on the tripod.

In the embodiment of FIG. 1 the stand is retractable against the body of base section 10 and comprises three legs 16, which are secured to a leg support ring 17, sometimes referred to as a collar or slider ring, that is slidable up and down along base member 10. The legs are further secured to base section 10 by stretcher bars or ties 18 connecting to the legs at the midregions of the legs and connecting at their opposite end to bottom ring 19 on base section 10. Ring 19 is open on its bottom to permit power cord 21 to exit through the bottom of the base section. In the embodiment of FIG. 1 an intermediate leg lock ring 22 is provided for locking legs 16 in place when the stand is retracted. Intermediate ring 22 is able to travel only a slight amount along base section 10 for locking and unlocking the legs as explained more fully below.

Figure 2:
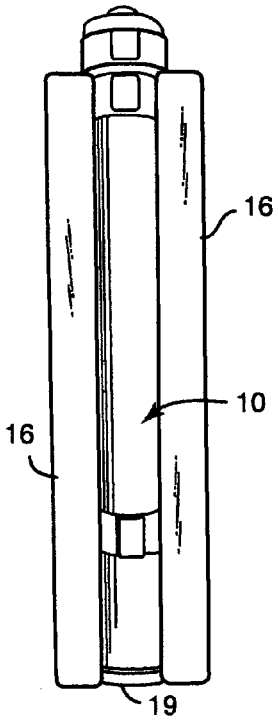
FIG. 2 is a perspective view of the worklight of FIG. 1 in its retracted configuration.

FIG. 2 shows the worklight embodiment of FIG. 1 in its fully retracted or collapsed configuration, in which lamp section 11 is fully retracted into base section 10 and legs 16 are folded up or collapsed against the base section. Intermediate ring 22 holds legs 16 in their collapsed configuration.

Figure 3:
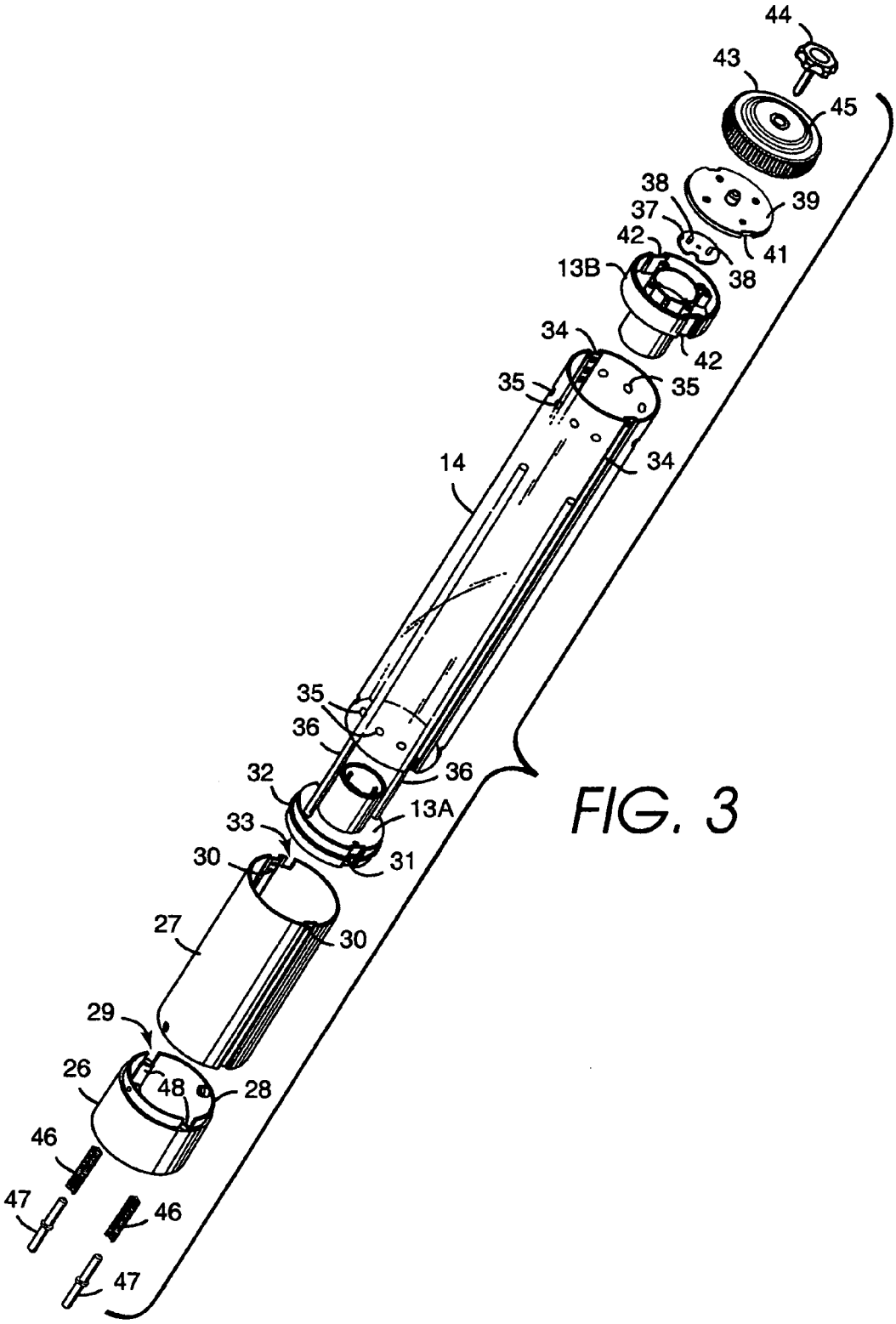
FIG. 3 is an exploded perspective view of the lamp section of the worklight in FIG. 1.

FIG. 3 provides a closer look at the embodiment of the lamp section 11 of FIG. 1. At the bottom end of the lamp section is a generally cylindrical support section 26 that serves as the base for the lamp section. Seating on the support section is a generally cylindrical intermediate section 27. The upper lip 28 of lamp-section support section 26 is formed with two diametrically opposed gaps 29 for positioning intermediate section 27, which is itself formed with a grooved portion defining an interiorly pointing rib or key 30 that mates with gap 29 to assure proper positioning and seating. A lower lamp socket 13A seats in the upper rim of intermediate section 27. Socket 13A is also keyed with a keyway 31 for proper alignment on intermediate section 27. Socket 13A is provided with an annular stop ring 32 that maintains the socket in its seated position on top of intermediate section 27 and prevents the socket from sliding into the intermediate section beyond the stop ring. The lower socket is secured to intermediate section 27, which is in turn secured to support section 26. In the embodiment of FIG. 3 the respective components are screwed or pinned together as indicated by the screw holes seen in FIG. 3, although the particular manner of securement is not significant to the invention and any convenient means of securement may be used. At the underside of lower socket 13A is a switch mechanism (not visible in FIG. 3) for energizing the lamps when the lamp section is extended out of the base section. The switch mechanism itself will be described below. At this stage it is noted that intermediate section 27 is provided with a window or gap 33 through which a switch actuator extends. Seated on the upper side of lower socket 13A is transparent shield member 14. The shield member slides over the edge of the socket and is maintained in its seated position by stop ring 32. The shield member is formed with an interiorly directed key 34, which mates with keyway 31 in lower socket 13A for proper positioning. The shield member is also formed with a plurality of vent holes 35 at its lower and upper extremities for air low through the shield member for ventilating the fluorescent lamps.

A pair of support members 36 are secured to lower socket 13A and extend upward through the interior region of shield member 14 and are secured at their opposite ends to upper socket 13B. Members 36 are hollow and serve as conduits providing a raceway for routing the electrical wiring from the lower socket to the upper socket. The sockets are formed with a pair of holes passing all the way through the socket bases that receive and hold the ends of the conduits. In this way a path is provided for the wiring from the bottom side of lower socket 13A through conduits 36 and through upper socket 13B to the top side of upper socket 13B. In this arrangement the two leads from the power cord are separated and one lead runs through each conduit. The tubular support members 36 play a dual role in this arrangement. They define a raceway for routing the power leads from the lower socket to the upper socket, and they provide a structural framework connecting the upper socket with the lower socket. While this arrangement is advantageous for ease of fabrication, other arrangements may be used in different embodiments of the invention. For example, a single conduit may be provided to route the electrical wires and a separate framework provided for structural integrity. A measure of structural integrity is provided by shield member 14, and greater solidity can be achieved by using a thicker shield member. With a sufficiently heavy-duty shield member 14, a simpler framework can be provided, for example, including only a single member extending from the lower to the upper socket for wire routing and for supporting the upper socket when the shield member is removed for re-lamping as explained below.

Mounted at the center portion of upper socket 13B is a small printed circuit board 37 that may hold circuitry for additional indicators or other specialized features of any particular embodiment. For example, in the embodiment of FIG. 3 two LEDs (light-emitting diodes) 38 are mounted on PCB 37. The PCB carries circuitry applying a low voltage for energizing the LEDs whenever the worklight is plugged into an electrical outlet but the worklight is not turned on, that is, whenever the worklight is plugged into an electrical outlet but the lamps 12 are not energized. The energizing of the optional LEDs is discussed below in connection with the actuator switch for turning the lamps on and off. The LEDs provide a low-level indicator to help the user locate the worklight in poorly lit environments, for example, when working at night on a construction site, and also serve to remind the user that even though the worklight may be turned off, it has not been unplugged from the outlet.

Mounted over PCB 37 on upper socket 13B is a cover 39, which preferably has sufficient extent to cover the entire socket so as to protect the user from contact with the electrical connections and circuitry. Cover 39 is indexed at 41 to receive key 34 on shield member 14. When one or more LEDs are provided as in FIG. 3, cover 39 is preferably transparent to permit the LED indicator light to shine through, although other means such as light pipes could also be used to conduct the indicator light to a location on the worklight exterior where it will be visible to the user. The upper end of lamp section 11 is closed off with a removable cap 43, which is held in place by knob 44 having a shaft that extends through cap 43 and screws into cover 39, which is securely fastened to upper lamp socket 13B. Four screw holes in cover 39 are visible in FIG. 3 for this purpose. Where LEDs are employed as in FIG. 3, cap 43 is then also preferably transparent so that the light from the LEDs will be visible through the cap. The cap may even be structured to have a diffusive effect to spread the indicator light out over an extended area. For example, cap 43 may be formed with diffusing ridges 45 for this purpose.

For replacing the lamps 12 the cap 43 may be removed by first unscrewing knob 44. Then the shield may be slid up and out the top of lamp section 11. The sockets will remain in place because they are securely connected to one another through conduits 36. The sockets are spaced apart from one another a sufficient distance to allow for lamps 12 to be unscrewed one at a time and removed from between the two sockets. When the new lamps are in place, the shield 14 is slid back in from the top and cap 43 is replaced and screwed down with knob 44.

Turning now to the bottom end of lamp section 11, support section 26 and intermediate section 27 are hollow and define a storage chamber for electrical power cord 21. When the worklight is in its fully retracted configuration as shown in FIG. 2, the cord can be coiled up and stored in this hollow area.

To assist in extending the lamp section, support section 26 is provided with a pair of compression springs 46 and associated plungers 47. The interior wall of support section 26 is formed with a pair of elongate cavities 48 for receiving the springs and plungers. As will be described in connection with FIG. 6, when lamp section 11 is retracted into base member 10, the plungers will be pushed into cavities 48 compressing springs 46. The compressed springs then provide an initial push on the lamp section when the lamp section is released to be extended, and the initial push from the springs causes the lamp section to pop up so that it may be easily grasped by the user and pulled out to its full extension.

Figure 4:
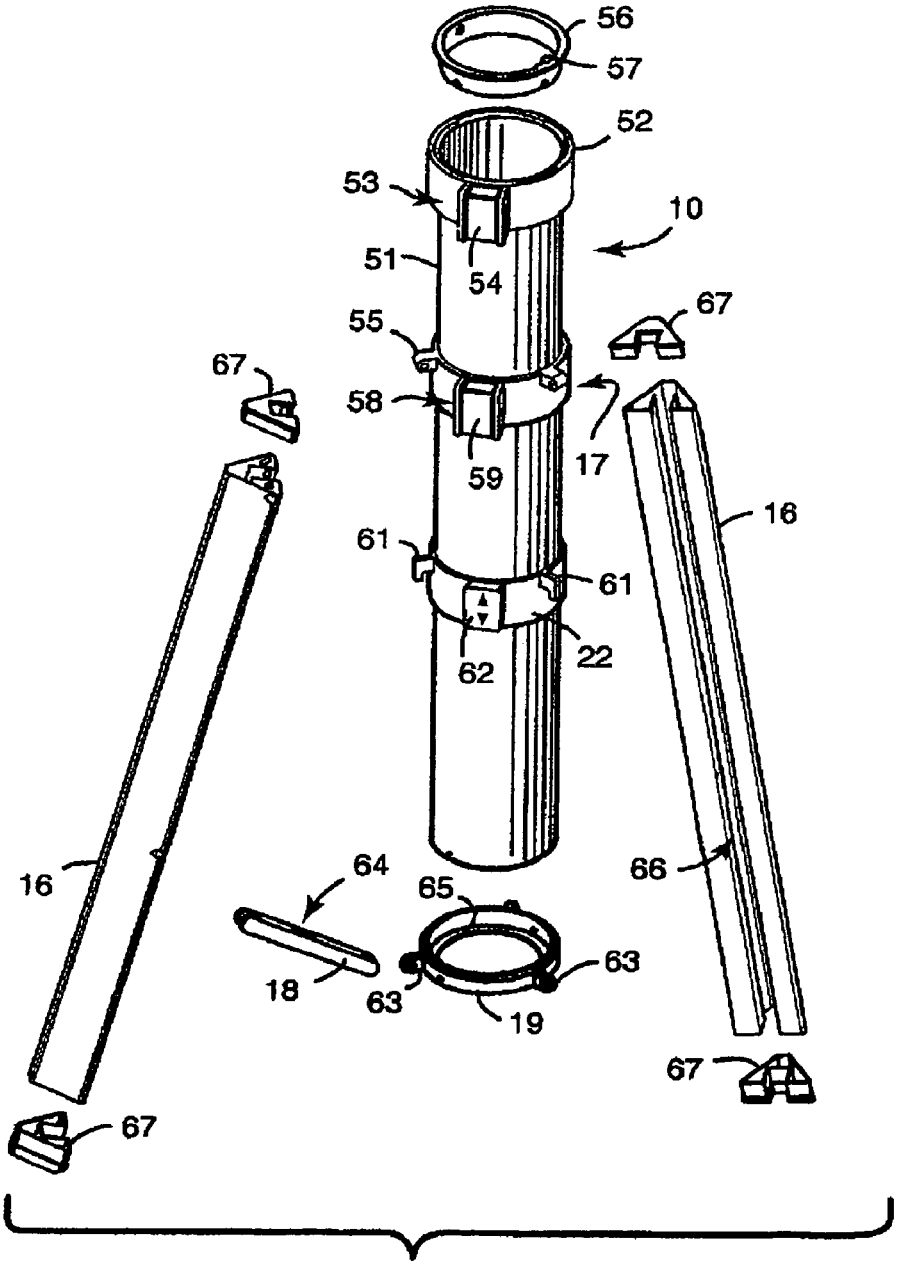
FIG. 4 is an exploded perspective view of the base section of the worklight in FIG. 1.

FIG. 4 provides a closer look at base section 10 and collapsible legs 16. Base section 10 comprises an elongate tubular member 51. In the illustrated embodiment the tubular member 51 is cylindrical with a circular transverse cross section. In general, however, the tubular member may take on other, for example, more ornamental shapes. In the simplest designs the transverse cross sectional profiles of tubular base member 51 and lamp section 11 will be coordinated so that the lamp section will slide in and out of the base section. Other designs may also be used, however, in which the base section has a different outer cross-sectional profile from the lamp section. The base section may have an outer shape, for example, chosen for its ornamental appearance and include an inner guide or framework permitting an independently shaped lamp section to slide in and out.

Firmly affixed to the top end of tubular member 51 is a latch ring 52, which includes a lamp-section latching mechanism indicated generally at 53 for releasably locking lamp section 11 in its retracted configuration in base section 10. The latching mechanism in the illustrated embodiment is provided by a pin and lever action described more fully below in connection with FIG. 6. In this embodiment the lamp section is released from the base section simply by pushing on lever 54 carried on latch ring 52. Other forms of mechanical latches can also be used to releasably lock the lamp and base sections together in their retracted configuration. The push-button lever mechanism shown here, however, is convenient to use.

Above latch ring 52 and firmly secured to the top of the base section is an upper bushing member 56 that serves to limit the size of the opening at the top of tubular member 51 so the lamp section will not slide completely out of the tubular member. Bushing member 56 is indexed at 57 to help maintain the alignment of the lamp section within the base section.

Below latch ring 52 on the base section is leg-support slider ring 17, which is free to slide up and down along tubular member 51. Leg support ring 17 includes a plurality of leg attachment lugs or ears 55, to which the legs 16 are rotatably attached at their upper ends. Leg support ring 17 includes a latch mechanism 58 for releasably locking the leg ring, hence the legs 16, in their retracted configuration on base section 10. In the illustrated embodiment the latch mechanism is of the same type as latch mechanism 53, although the two latch mechanisms need not be the same. The illustrated latch mechanism 58 enables the legs to be released simply by pushing on lever 59.

Below leg support ring 17 slidably mounted on tubular member 51 is intermediate leg lock ring 22. The leg lock ring includes a plurality of leg locking members 61, one for each leg 16. In the illustrated embodiment these take the form of a hook, which serves to hold the legs securely in their folded-up configuration against base section 10. The leg lock ring carries a leg latch mechanism 62, which is described in more detail in connection with FIG. 6, and which in the illustrated embodiment releasably locks the leg lock ring into upper and lower positions. When the leg lock ring is slid to the upper position, the legs are freed to be folded out from the base section into their deployed configuration. When the legs are folded in and leg lock ring is slid to the lower position, the legs are securely held against the base section.

Securely affixed to the bottom of tubular member 51 is bottom ring 19, which is provided with lugs 63 for attaching stretcher bars or ties 18. The ties 18 rotatably attach at one end to bottom ring 19 and at the other end to a midregion of legs 16 and serve to prevent the legs from splaying out too far. Ties 18 are formed with a hollow interior portion and a hole 64 in the side facing tubular member 51, which is shaped and dimensioned to receive a leg locking member 61 on leg lock ring 22 for holding the tie against tubular member 51 in the folded configuration.

Bottom ring 19 is formed with an interiorly extending lip 65, which provides a surface for plungers 47 to push against when lamp section 11 is fully retracted into base section 10. Ring 19 is otherwise open at its center to provide an opening for electrical cord 21 to exit.

In the illustrated embodiment legs 16 are formed with a generally triangular cross sectional profile with an interior groove 66 for receiving ties 18 when the legs are fully folded up against base section 10. This arrangement provides for a more compact folded unit. The generally triangular legs are capped with generally triangular end caps 67.

Figure 5:
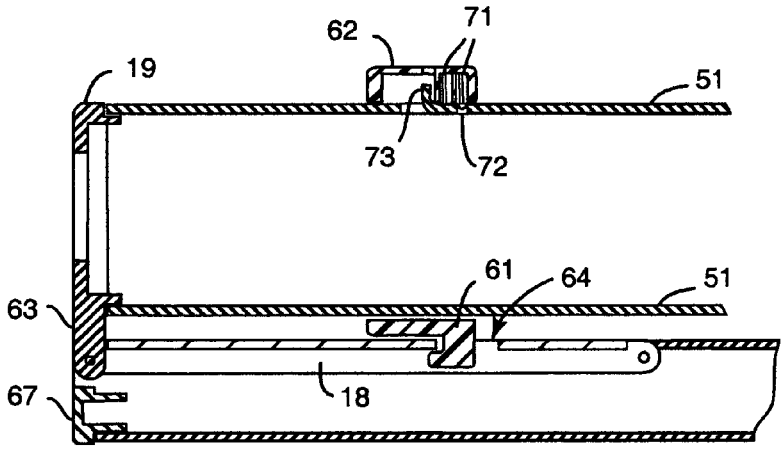
FIG. 5 is a cross-sectional view of the lower portion of the worklight of FIG. 1 showing a leg locking mechanism.

FIG. 5 shows an embodiment of leg lock latch mechanism 62 on leg lock ring 22. The latch 62 is includes two ball detents 71, and tubular member 51 is formed with a hole 72 for receiving the ball detents. Latch 62 has an interior cavity, into which extends a tang 73 bent up from tubular member 51. Tang 73 limits the travel of leg lock ring 22 up and down tubular member 51 and also prevents the ring from rotating. The ring 22 may be pushed down until the upper ball detent is received in hole 72 indicating the locked ring position. The ring may be pushed up until the lower ball detent is received in hole 72 indicating the upper, unlocked position of the ring. Leg lock hook 61 is moved down to engage tie 18 or up so that the hook is free to slide out of opening 64.

Figure 6:
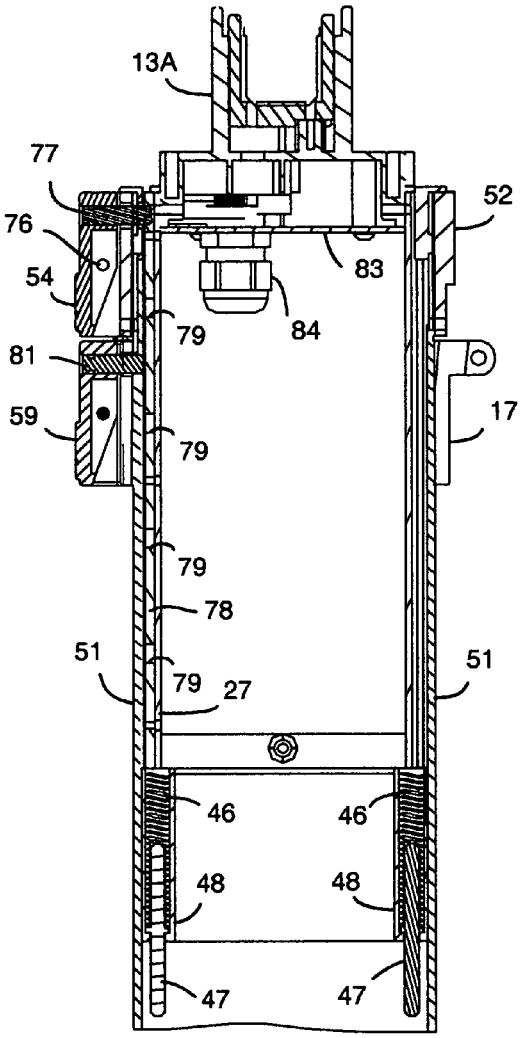
FIG. 6 is a cross-sectional view of the lower portion of the lamp section of the worklight of FIG. 1.

FIG. 6 shows the latching mechanisms 53 and 58 for latch ring 52 and leg support ring 17. The latching mechanism 53 includes a lever member 54, which rotates about a horizontal pin 76. At the upper end of lever member 54 is a latch pin 77 affixed to the lever member. The lever member is preferably biased to urge the latch pin inward, for example, by a spring around horizontal pin 76. A rack member 78 is affixed in the groove 30 on the outside of intermediate member 27. Recall that the inwardly directed side of groove 30 defined a key for alignment of the socket 13A in intermediate member 27. Rack member 78 has a plurality of holes 79 for receiving latch pin 77, which extends through a hole in tubular member 51 and into a selected one of the holes 79 to affix lamp section 11 in its extended position. With a plurality of spaced apart holes in rack member 78, the user has a selection of heights to which the lamp section can be extended.

The latch mechanism 58 for leg support ring 17 is structured similarly. It has a lever member 59 which rotates about a horizontal pin and has a latch pin 81 at the upper end. Latch pin 81 only extends into a hole in tubular member 51 to lock the leg support ring 17 in position. Latch pin 81 does not function to lock the lamp section in place, hence it is not necessary for latch pin 81 to reach to rack member 78.

Also shown in FIG. 6 is a cover 83 on the bottom of lower socket 13A and a strain relief pass-through 84 for electrical power cord 21. FIG. 6 shows the disposition of the springs 46 and plungers 47 in the support ring 26. The springs and plungers are retained in tubular cavities 48. When the lamp section is fully collapsed into the base section, plungers 47 are pushed into cavities 48 by contact with rim 65 of bottom ring 19. When the latch 54 is pressed, the lamp section is released and springs upward under the action of coil springs 46.

Figure 6A:
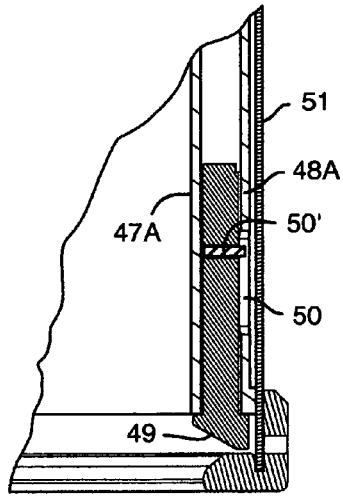
FIG. 6A is a cross-sectional view of an alternative spring plunger for the lower portion of the lamp section.

FIG. 6A shows an alternate form of plunger 47A for use in place of plungers 47. The plunger 47A is formed with an inwardly pointing chamfered bottom surface 49. This surface helps to guard against cord pinch when electrical cord 21 is stuffed into the hollow interior of tubular member 51. An extra length of flexible loose cord can be urged against the interior wall of the tubular member. To guard against the lower end of the lamp section pinching the cord under the plunger as the lamp section is retracted all the way into the base section, the plungers are formed with chamfered surface 49 to urge the cord out of the way should the surface contact the cord. Also seen in FIG. 6A is an alternative construction for retaining the plunger in the tubular plunger cavity 48A. The cavity wall is formed with a vertically extending slot 50, and plunger 47A is provided with a pin 50' extending into and cooperating with slot 50 to limit the vertical travel of the plunger.

Figure 7:
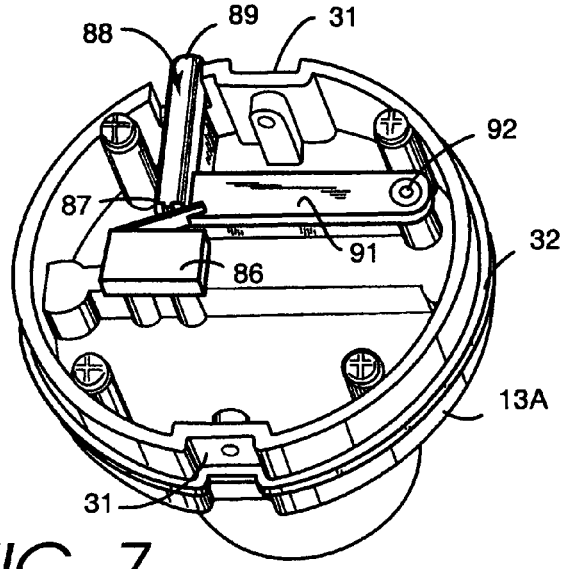
FIG. 7 is a perspective view of the bottom of a lamp socket showing a switch mechanism.

The electrical switch mechanism for energizing lamps 12 is mounted on the bottom of lower lamp socket 13A. FIG. 7 shows the underside of lamp socket 13A with the cover 83 removed. The electrical wires have also been left out of the figure for better visibility. Securely mounted on the underside of the socket base is a micro switch 86 with switch lever 87. An actuator 83 with an elbow bend in it is also mounted on the socket base to enable the main arm 89 to move in and out engaging switch lever 87 as it moves. This is achieved in the illustrated embodiment by pinning the other arm 91 of the actuator to rotate about the point 92. The active arm 89 extends through a gap in the socket base and through the gap 33 in intermediate section 27. The normal position of the micro switch, when switch lever 87 is extended, is ON. When the lamp section is retracted into the base section, the contact end of actuator arm 89 comes in contact with the interior wall of the base section and is pushed in so as to depress switch lever 87. When the lamp section is extended, actuator arm 89 penetrates through gap 33, relieving switch lever 87 to return to its extended, normally ON position, which turns on the micro switch.

In a simple embodiment when micro switch 86 is in its ON position, it closes the circuit connecting the power leads to the lamp sockets so as to energize the bulbs, and when the micro switch is in its OFF position (when the lamp section is retracted into the base section), the micro switch disconnects the power leads from the lamp sockets. In an alternative embodiment including LED indicator lights, such as described above in connection with FIG. 3, when the micro switch is in its nominal OFF position, the switch disengages the main power leads from the lamp sockets and instead connects the power leads to a low-voltage DC supply circuit, which supplies low-voltage DC power to the LEDs causing them to turn on. Such low-voltage DC supply circuits are well known and need not be described in detail here. An appropriate circuit may be provided, for example, by a diode bridge rectifier with capacitor filter and Zener diode regulator arrangement.

Figure 8:
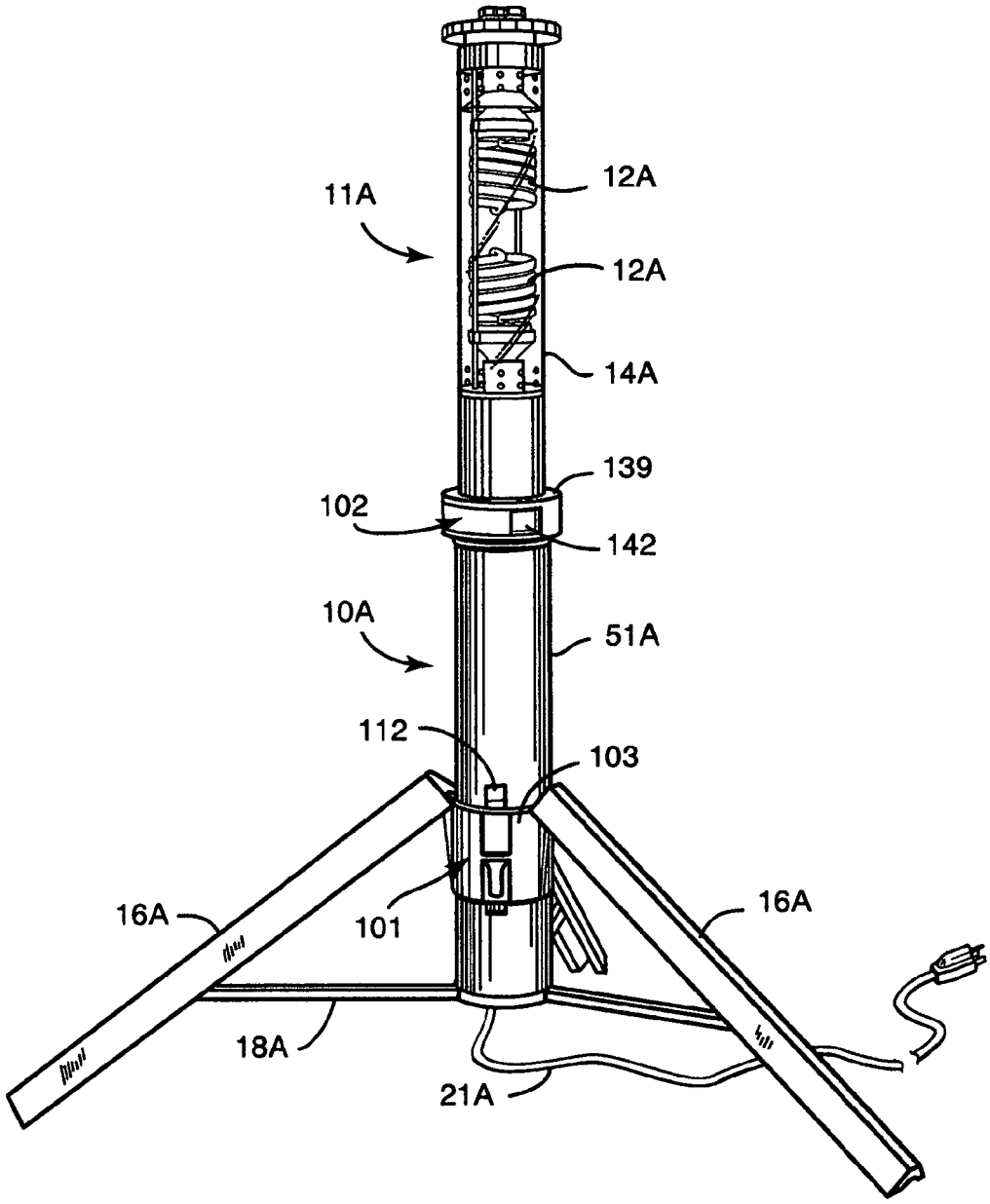
FIG. 8 is an overall perspective view of an alternative embodiment of a worklight in its deployed configuration.

FIG. 8 shows an alternative embodiment of worklight, in which component parts corresponding to similar portions in the embodiment described above are given corresponding reference numerals with the suffix A appended. Thus, the worklight of FIG. 8 comprises a base section 10A, lamp section 11A, a pair of self-ballasted fluorescent bulbs 12A, shield member 11A, collapsible legs 16A and power cord 21A. This embodiment has a different form of leg latch mechanism, indicated generally at 101, and different form of lamp-section latching mechanism, indicated generally at 102.

Figure 9A:
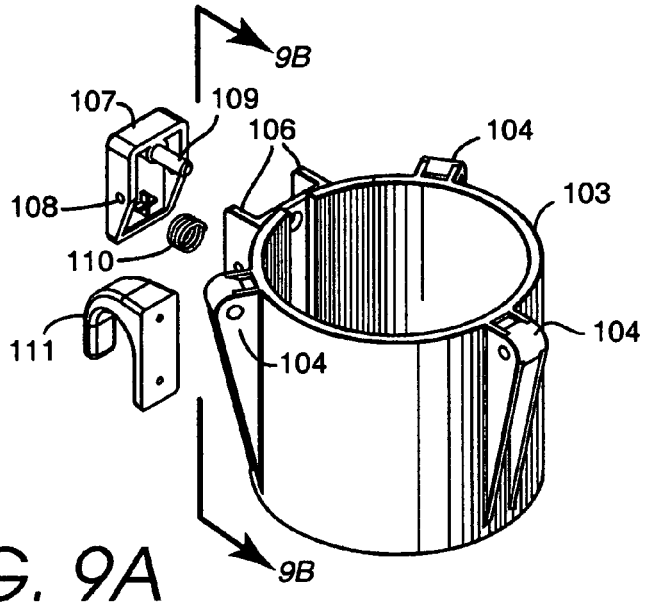
FIGS. 9A and 9B are an exploded view and cross sectional view, respectively, of the leg latching mechanism in the embodiment of FIG. 8.
Figure 9B:
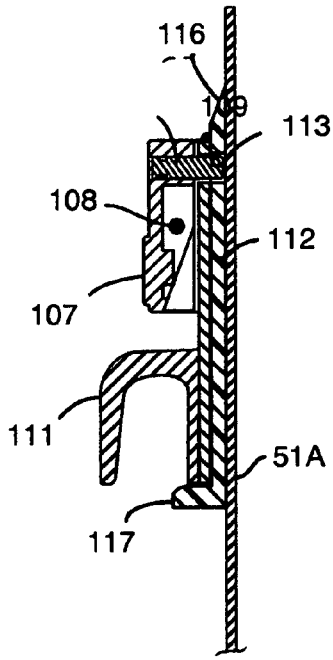

The leg latch mechanism is described with reference to FIGS. 8, 9A and 9B. A leg-supporting slider ring 103, sometimes referred to as a collar, encircles tubular member 51A and is free to slide up and down along the tubular member. The slider ring includes anchors or ears 104 for pivotally attaching the ends of legs 16A to the slider ring. Extending outward on one side of the slider ring is a pair of narrow side walls 106, on which is mounted a latching lever 107. The lever 107 pivots about a horizontal pivot pin 108, which extends into the side walls 106. A latch pin 109 is positioned at one end of the latching lever, and a coil spring 110 is provided for biasing the latch pin into its latching position. While a coil spring in the arrangement of FIG. 9A is convenient, other biasing techniques may also be used, for example, a torsional spring around pivot pin 108. Below the latching lever affixed to the slider ring is a hooked handle 111, for the assistance of a user in releasing the latching mechanism. The user grasps handle 111 with the index finger and depresses latching lever 107 with the thumb against the spring tension of biasing spring 110. Mounted on tubular member 51A toward the lower end is an elongate latching catch 112, which defines a hole 113 for receiving latch pin 109. Slider ring 103 is formed with a channel 114 in its inner surface for receiving latching catch 112. The upper end of catch 112 is tapered, as indicated at reference numeral 116. As the slider ring is slid down along tubular member 51A, latch pin 109 contacts the sloped surface 116 of catch 112 and is urged outward, which pivots the latching lever about horizontal pin 108. With further movement down tubular member 51A, latch pin 109 drops into the catch hole 113. As the slider ring is slid down, legs 16A are urged into their deployed configuration by stretcher bars 18A. The bottom end of latching catch 112 is formed with a protruding stop 117 as a precaution to arrest downward movement of slider ring 103 beyond the normal latched position of the slider ring, for example, if latching lever 107 should be held in while the slider ring and latch pin 109 are slid over catch hole 113. This prevents overextension of the legs and undue stress on the stretcher bar connections.

In the collapsed configuration the slider ring is not latched to tubular member 51A, but is free to slide down. In practice the legs tend to stay in their collapsed configuration even with no latching mechanism operating because, once the legs are brought to the collapsed configuration, the weight of the legs themselves tends to hold the legs in the collapsed configuration. To deploy the legs from the collapsed state, it is generally only necessary to push the legs slightly outward from the axis of tubular member 51A beyond a threshold amount, and then the legs will splay out under the action of gravity and slider ring 103 will slide along tubular member 51A until the ring latches at the catch 112. For security a strap may be provided at the distal end of one of the legs, which may be wrapped around the legs when in their collapsed configuration and secured by any convenient means, such as a hook and loop fastener, buckle or snap connector. In addition, a carrying strap may be secured to one of the legs.

Figure 10:
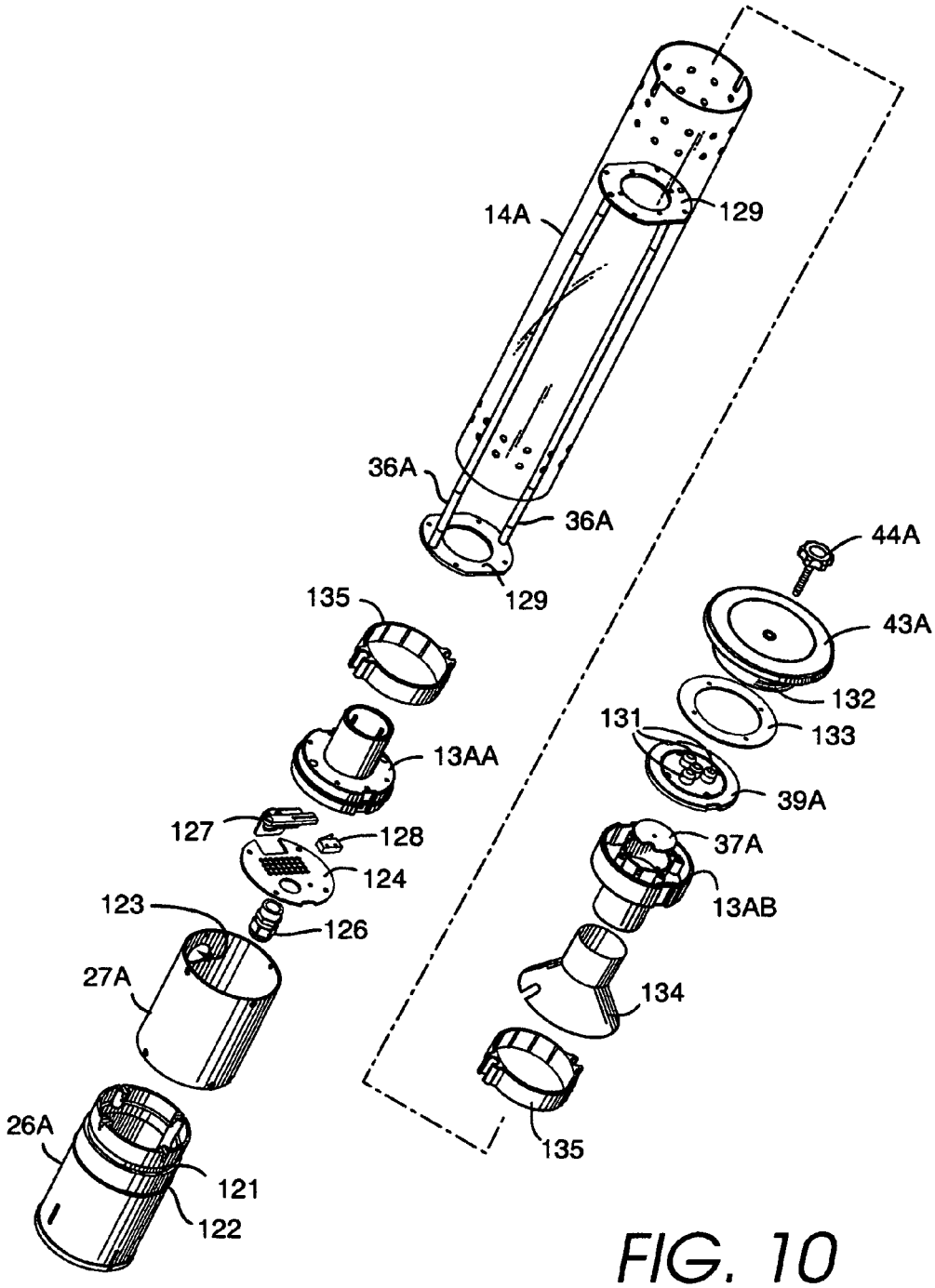
FIG. 10 is an exploded perspective view of the lamp section of the worklight in FIG. 8.

FIG. 10 shows the lamp section in the embodiment of FIG. 8 where, as before, corresponding parts are given corresponding reference numerals with the suffix A appended. Bottom support section 26A includes an annular groove 121 that serves as part of the lamp-section latching mechanism. Groove 121 cooperates with a catch on the base member, to be described below, to latch the lamp section in its open configuration. Beneath annular groove 121 is an annular ridge 122 that serves as a stop ring to prevent the lamp section from being pulled entirely out of the base section in the event that the lamp-section latching mechanism is disabled or intentionally held open. Intermediate section 27A in this embodiment serves as a spacer for positioning the lower lamp socket at the right height above the positioning groove 121. It also defines an aperture 123 for the lamp actuator switch, as described below. The lower and upper lamp sockets are labeled, respectively, 13AA and 13AB. Plate 124 is a bottom and cover plate for lamp socket 13AA. A strain-relief feedthrough 126 is secured to the plate 124 and passes the electrical cord through to the lamp sockets. Switch actuator 127 and micro switch 128 are attached to the underside of lower socket 13AA and covered by plate 124. Tubular conduits 36A are firmly secured at their ends to support plates 129, which are in turn secured to the bases of the lower and upper sockets. Printed circuit board 37A fits in the base of upper socket 13AB and, as in the above the embodiment, includes three LEDs (not shown in FIG. 10). Cover plate 39A covers a printed circuit board 37A and seals off the base of upper socket 13AB. Cover plate 39A includes three transparent bosses 131 receiving the three LEDs. Cap 43A is transparent so that the light emitted by the LEDs is visible through the cap. On the underside of cap 43A is a spacer portion 132. An annular catch plate 133 is secured to the bottom of the spacer portion so that there is a gap formed between the rim of cap 43A and catch plate 133. This gap defines an annular groove around the cap/catch-plate unit. This annular groove is comparable to annular groove 122 in the bottom support section 26A and cooperates with the catch on the base member to latch the lamp section in its closed configuration. The lamp section may also include a rain shield 134 (also seen in FIG. 8), which mounts on the socket 13AB and effectively provides an umbrella for the bulb below. Also shown in FIG. 10 are two elastomeric shock absorbing support rings 135, which fit around the base of fluorescent bulbs installed in the sockets 13AA and 13AB. The rings are formed with opposed side pieces 136, which clip onto conduit members 36A. These rings stabilize the bulbs and protect them against damage in the event the worklight is subjected to harsh treatment.

Figure 11:
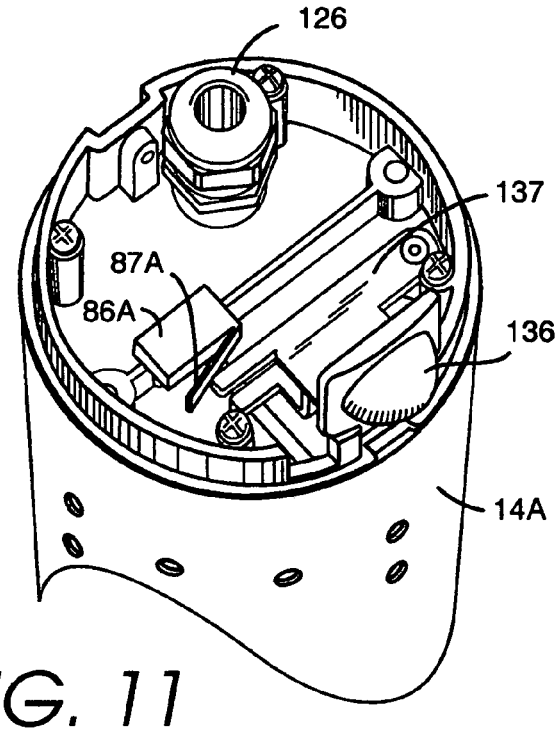
FIG. 11 is a bottom view of a lamp socket showing an alternative switch mechanism in the embodiment of FIG. 8.

FIG. 11 shows micro switch 86A mounted on the underside of lower socket 13AA. Also illustrated in FIG. 11 are strain-relief feedthrough 126 and shield member 14A, on which several vent holes are visible. Micro switch 86A is operated by an actuator mechanism comprising button 137 and spring-biased actuator arm 138. The mechanism is mounted so that button 137 aligns with aperture 123 and is urged through the aperture under the action of spring-biased actuator arm 138. When the lamp section is retracted into the base section, button 137 is depressed by contact with the interior wall of the base section, and micro switch 86A is maintained in its normally OFF position. As the lamp section is withdrawn from the base section, button 137 clears the upper edge of the base section and is then able to project through the aperture 123 in intermediate section 27A under the action of the spring-biased actuator arm 138. Micro switch 86A then goes to its normally ON position.

Figure 12:
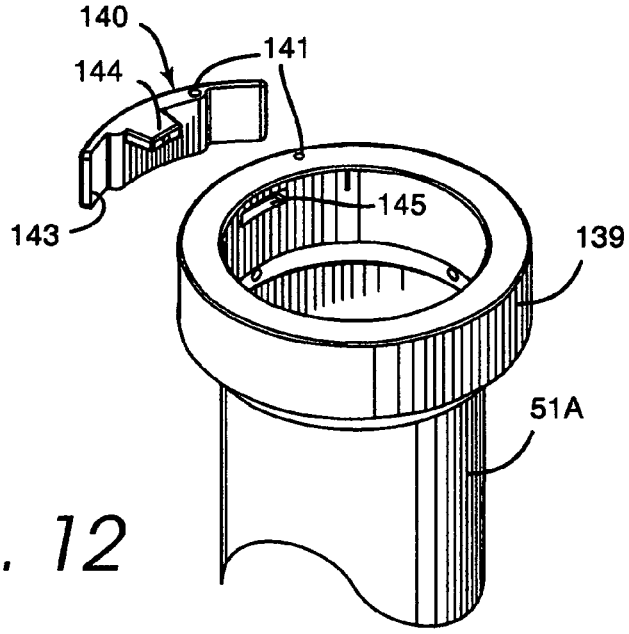
FIG. 12 is a partially exploded perspective view of a lamp-section latching mechanism in the embodiment of FIG. 8.

FIG. 12 shows the lamp-section latching mechanism 102. Tubular member 51A terminates in a cap 139 having a diameter greater than that of tubular member 51A and comparable to the diameter of cap 43A on the lamp section. An actuator arm 140 is pivotally mounted on cap 139 at the position indicated by reference numeral 141. The actuator arm rests in a recessed area 142 in the side of cap 139 as may be seen in FIG. 8 and is biased so that the arm is normally flush with the side of the cap. The arm has a tab 143 to be engaged by a user and a catch 144 that holds the lamp section in its open or closed disposition. When the sections are in their retracted configuration, catch 144 extends through an aperture 145 in the cap side and into the gap between the rim of lamp-section cap 43A and catch plate 133 so that the lamp section cannot be extended. To release the lamp section, a user pulls tab 143 to pivot the arm thereby withdrawing catch 144 from the gap and releasing the lamp section. When the lamp section is released in this manner, it is urged upward by the action of the spring-and-plunger arrangement in support section 26A such as that shown in FIGS. 3 and 6. When the lamp section is then fully extended, catch 144 extends into groove 121 in support section 26A at the bottom end of the lamp section, thereby holding the lamp section in its extended configuration.

Figure 13:
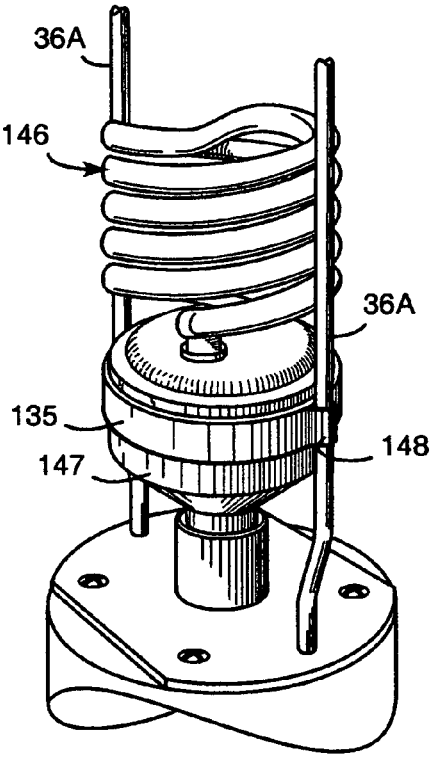
FIG. 13 is a perspective view of a fluorescent lamp with tubular and elastomenc support members.

FIG. 13 is a perspective view of a fluorescent lamp with tubular and elastomenc support members.

FIG. 13 shows a fluorescent lamp 146 being supported against tubular support members 36A by an elastomeric support ring 135. Lamp 146 has a lamp base 147. Ring 135 is sized to fit around the base and is preferably of a firm elastomeric material to provide a snug fit around the base. The support ring is formed with protruding side pieces 148 at the position of each support member 36A. The side pieces are formed with a vertical bore through them and are formed with a vertical slit at their farthest reach, through which the tubular member is inserted into the side piece so that the two arms of a side piece wrap around a tubular member 36A. The construction of the side pieces in this embodiment may be seen in FIG. 10 where the two arms of each side piece are visible. Support ring 135 may also be formed with vertical ridges on its inner surface to assist in sliding the ring on and off lamp base 147 for re-lamping. Under conditions of use in the field the worklight may bumped into, knocked over, or subjected to other mechanical stresses that could damage the fluorescent lamps, which tend to be easily damaged. The elastomeric material serves to cushion mechanical shock and to damp vibrations experienced by the lamp and thereby provide a measure of protection for the lamp. A suitable elastomeric material may be selected empirically for the particular worklight embodiment.

The invention has been illustrated herein in a worklight having a lamp section with two fluorescent lamps. In an alternative embodiment the lamp section can also be structured with only a single socket at either the bottom or the top end to provide a worklight with only a single lamp.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims. Any limitation in the claims not expressly using the word "means" is not intended to be interpreted as a "means plus function" limitation in accordance with Title 35, United States Code, Section 112, and any claim limitation expressly using the word "means" is intended to be so interpreted.

What is claimed is:

1. A portable worklight comprising:

an elongate lamp section including one or more lamp sockets for receiving one or more fluorescent lamps having a self-contained ballast, said lamp section including a substantially transparent shield about said one or more lamps mounted in said one or more sockets, said shield and said lamp section being structured and arranged to pass illumination from said lamps substantially in a full circle about said elongate lamp section; and an elongate base section structured;

said lamp section and said base section being structured and arranged to have an extended configuration for providing said illumination in said substantially full circle and a retracted configuration wherein said lamp section is retracted into said base section for transporting and storing the worklight; and further comprising a support on said worklight for supporting said worklight during use.

2. The worklight of claim 1, wherein said support comprises a stand affixed to said base section for supporting said worklight during use.

3. The worklight of claim 2 wherein said stand comprises a plurality of legs collapsibly attached to said base section, said legs and their manner of attachment being structured and arranged to define a collapsed configuration against said base section for transporting and storing the worklight and a deployed configuration for supporting the worklight during use.

4. The worklight of claim 3, further comprising a collar mounted to slide along said base section wherein said legs are rotatably attached at first ends thereof to said collar, whereby in said collapsed configuration said collar is slid into position toward one end of said base section and in said deployed configuration said collar is slid into position toward the opposite end of said base section.

5. The worklight of claim 4 further comprising:

a plurality of bars rotatably attached to said base section proximate said opposite end of said base section and rotatably attached to said legs at the midportion of said legs; and a leg-latching mechanism having a first portion mounted on said collar and a second portion defining a latched position of said collar in said deployed configuration.

6. The worklight of claim 5 wherein said leg-latching mechanism has no latched position in said collapsed configuration.

7. The worklight of claim 1 wherein said lamp section includes two of said lamp sockets disposed in opposition to one another so as to maintain said lamps aligned end to end substantially along the longitudinal axis of said elongate lamp section.

8. The worklight of claim 7, further comprising at least one elongate support member extending between said two lamp sockets and being structured and arranged to support said two lamp sockets in opposition to one another.

9. The worklight of claim 8 wherein said at least one support member defines a conduit for electrical wires between said two lamp sockets.

10. The worklight of claim 9 wherein said support member comprises a pair of tubular members arranged for said electrical wires to pass through their interior.

11. The worklight of claim 8, further comprising:

a shock absorbing ring member dimensioned to fit snugly around the base of a said fluorescent lamp, said ring member including protruding side piece structured and arranged to fit about said at least one elongate support member.

12. The worklight of claim 1 further comprising a switch assembly arranged such that said lamps are energized automatically wher said lamp section is extended from said base section.

13. The worklight of claim 12 wherein said switch assembly comprises an actuator movable between an ON and an OFF position, said actuator having a contact portion, said actuator being arranged such that said contact portion extends beyond an exterior wall of said lamp section when said actuator is in said ON position;

said actuator being mounted on said lamp section at a location below said one or more lamp sockets, and said actuator being disposed so that said contact portion engages a portion of said base member as said lamp section is retracted into said base member;

whereby said actuator is moved to said OFF position when said lamp section is retracted into said base member and is moved to said ON position when said lamp section is extended out of said base section.

14. The worklight of claim 1, further comprising:

a releasable lamp-section latching mechanism for holding said lamp section in said base section in said collapsed configuration; and at least one spring disposed so as to urge said lamp section to extend from said base section upon release of said releasable lamp-section latching mechanism.

15. The worklight of claim 14, further comprising:

at least one spring-biased plunger arrangement disposed so as to urge said lamp section to extend from said base section upon release of said releasable lamp-section latching mechanism.

16. The worklight of claim 15 wherein said spring biased plunger arrangement includes a plunger having a distal end formed with a sloped surface.

17. The worklight of claim 15 wherein said at least one spring-biased plunger arrangement is disposed within said lamp section.

18. The worklight of claim 1 further comprising:

one or more LEDs; and an electrical switch arrangement having first and second switch positions, wherein in said first position said one or more fluorescent lamps are energized and in said second position said fluorescent lamps are de-energized and said LEDs are energized.

* * * * *